US006319034B1

(12) United States Patent
Takakura et al.

(10) Patent No.: US 6,319,034 B1
(45) Date of Patent: Nov. 20, 2001

(54) INTERFACE STATION INCLUDING SIMPLY DETACHABLE CONNECTION APPARATUS AND INFORMATION PROCESSING APPARATUS CONNECTABLE WITH INTERFACE STATION

(75) Inventors: Takayo Takakura; Kazuhiro Fujita, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/177,454

(22) Filed: Oct. 22, 1998

(30) Foreign Application Priority Data

Oct. 23, 1997 (JP) ..... 9-291344

(51) Int. Cl.[7] ..... H01R 13/62
(52) U.S. Cl. ..... 439/310
(58) Field of Search ..... 439/310, 538, 439/347, 157, 259, 928.1; 361/395

(56) References Cited

U.S. PATENT DOCUMENTS 5,292,267 * 3/1994 Kobayashi et al. ..... 439/310
5,919,055 * 7/1999 Hattori ..... 439/310

FOREIGN PATENT DOCUMENTS 3127934 12/1991 (JP) .

* cited by examiner

*Primary Examiner*—Tulsidas Patel
*Assistant Examiner*—Chandrika Prasad
(74) *Attorney, Agent, or Firm*—Adams & Wilks

(57) ABSTRACT

To prevent a portable electronic apparatus from being scratched when the portable electronic apparatus is connected to an interface station, the interface station is arranged by an operation member moved by being externally manipulated; a movable member moved in association with the movement of the operation member; a supporting member for supporting a portable electronic apparatus; and a first connecting terminal provided on the movable member, for electrically connecting the portable electronic apparatus. The portable electronic apparatus is held by both the supporting member and the movable member, so that the portable electronic apparatus is electrically connected via the interface station to an external information processing apparatus. In this interface station, an opening portion is formed in one of the operation member and the movable member; and a convex portion inserted into the opening portion is formed on the remainder of the operation member and the movable member. As a result, said movable member is moved in connection with the movement of the operation member by engaging the convex portion with the opening portion.

19 Claims, 8 Drawing Sheets

INTERFACE STATION INCLUDING SIMPLY DETACHABLE CONNECTION APPARATUS AND INFORMATION PROCESSING APPARATUS CONNECTABLE WITH INTERFACE STATION

BACKGROUND OF THE INVENTION

1. Field of the Invention

The present invention generally relates to an interface station capable of connecting a portable electronic apparatus such as an electronic wrist watch to a personal computer. More specifically, the present invention is directed to a connection means capable of simply detaching such a portable electronic apparatus with the interface station.

2. Description of the Prior Art

In a conventional interface station used to connect a portable electronic apparatus to an external information processing apparatus, a concave connecting portion is required to be formed in the portable electronic apparatus itself as a fixing means for connecting the interface station to the portable electronic apparatus.

Also, such a portable electronic apparatus is mounted/detached to/from this conventional interface station by utilizing elasticity of a fixing member provided on a portion of this interface station.

However, the above-described conventional interface station has such a problem in that since the concave portion must be formed in the portable electronic apparatus, there is a limitation in designing of this interface station. Also, when the portable electronic apparatus is removed, or detached from the conventional interface station, there is another problem. That is, unless the portable electronic apparatus is detached from the interface station while depressing this portable electronic apparatus, this portable electronic apparatus jumps out from the interface station, so that the portable electronic apparatus itself is scratched.

SUMMARY OF THE INVENTION

Therefore, the present invention has been made to solve the above-described problems, and has an object to provide a connection apparatus capable of simply mounting/detaching a portable electronic apparatus on/from an interface station.

To achieve the above object, an interface station according to an aspect of the present invention is featured by being arranged by employing: an operation member moved by being externally manipulated to attach or detach a portable electronic apparatus to the interface station; a movable member moved in association with the movement of the operation member; a supporting member for supporting a portable electronic apparatus; and a first connecting terminal provided on the movable member, for electrically connecting the portable electronic apparatus; wherein the portable electronic apparatus is held by both the supporting member and the movable member, so that the portable electronic apparatus may be electrically connected via the interface station to an external information processing apparatus.

In accordance with the interface station with employment of the above-described arrangement, both the fixing means and the concave portion functioning as the mounting/detaching means of the conventional structure can be omitted from the portable electronic apparatus. As a result, the degree of freedom in designing the portable electronic apparatus can be improved. Also, the portable electronic apparatus can be mounted/detached on/from the interface station without scratching this portable electronic apparatus. Moreover, since the operability of this interface station can be improved, the portable electronic apparatus can be simply connected with this interface station.

The interface station according to the present invention is arranged in such a manner that when the operation member is manipulated, the movable member and the first connecting terminal are moved in association with the movement of this operation member to permit a portable electronic apparatus to be mounted and detached from the interface station. As a consequence, the portable electronic apparatus can be easily mounted/detached on/from this interface station. At the same time, when the portable electronic apparatus is mounted on the interface station, the electrical connection can be established between the portable electronic apparatus and interface station.

BRIEF DESCRIPTION OF THE DRAWINGS

For a better understanding of the present invention, reference is made to a detailed description to be read in association with the accompanying drawings, in which.

DETAILED DESCRIPTION OF THE PREFERRED EMBODIMENTS

Referring now to drawings, an embodiment of the present invention will be described in detail.

Figure 1:
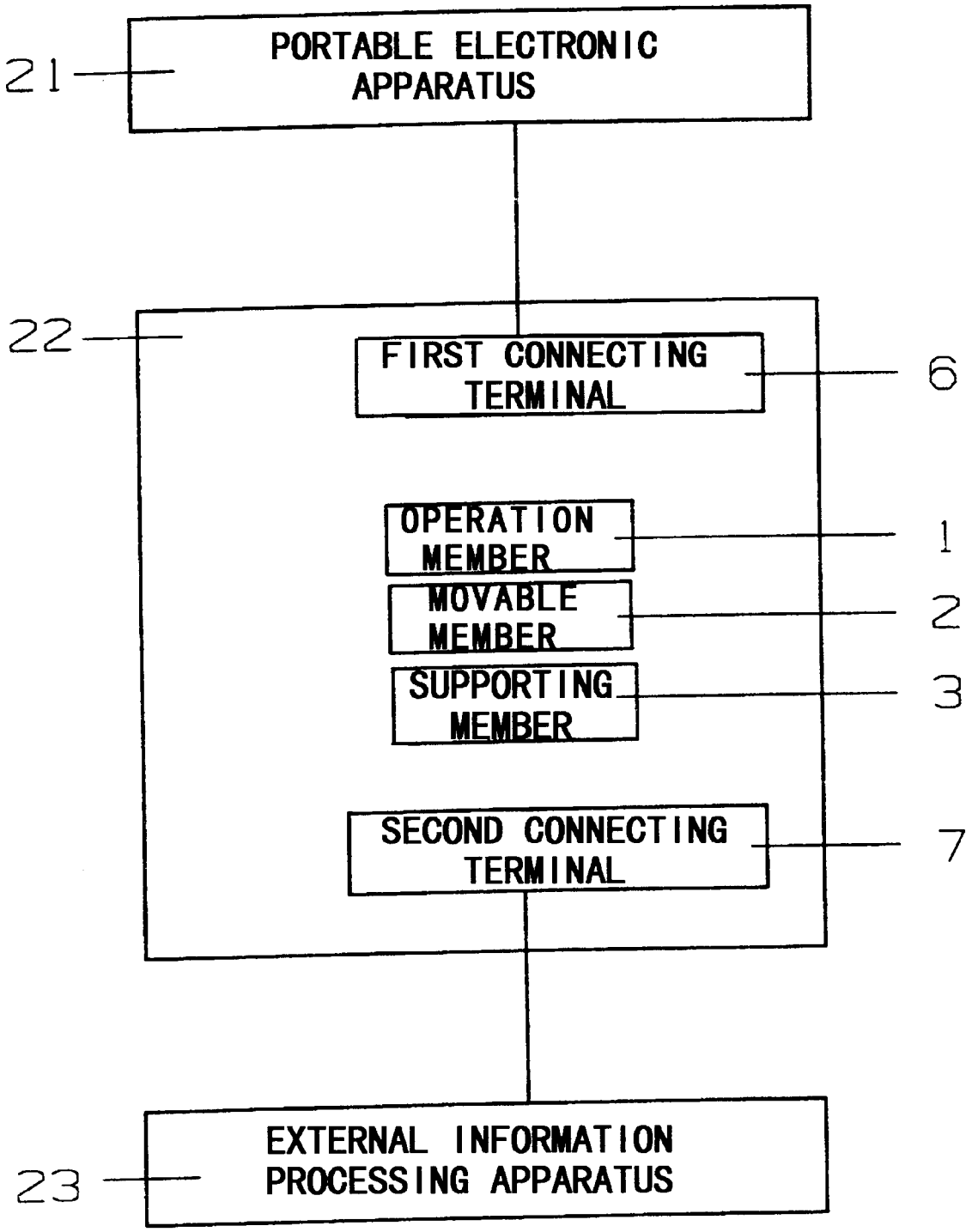
FIG. 1 is a schematic block diagram for representing an arrangement of an information processing apparatus according to an embodiment of the present invention.

FIG. 1 represents a functional block of the present invention. In this drawing, reference numeral 21 indicates a portable electronic apparatus, reference numeral 22 shows an interface station, and reference numeral 23 denotes an external information processing apparatus. The interface station 22 is comprised of an operation member 1, a movable member 2, a supporting member 3, a first connecting terminal 6, and a second connecting terminal 7.

Figure 2:
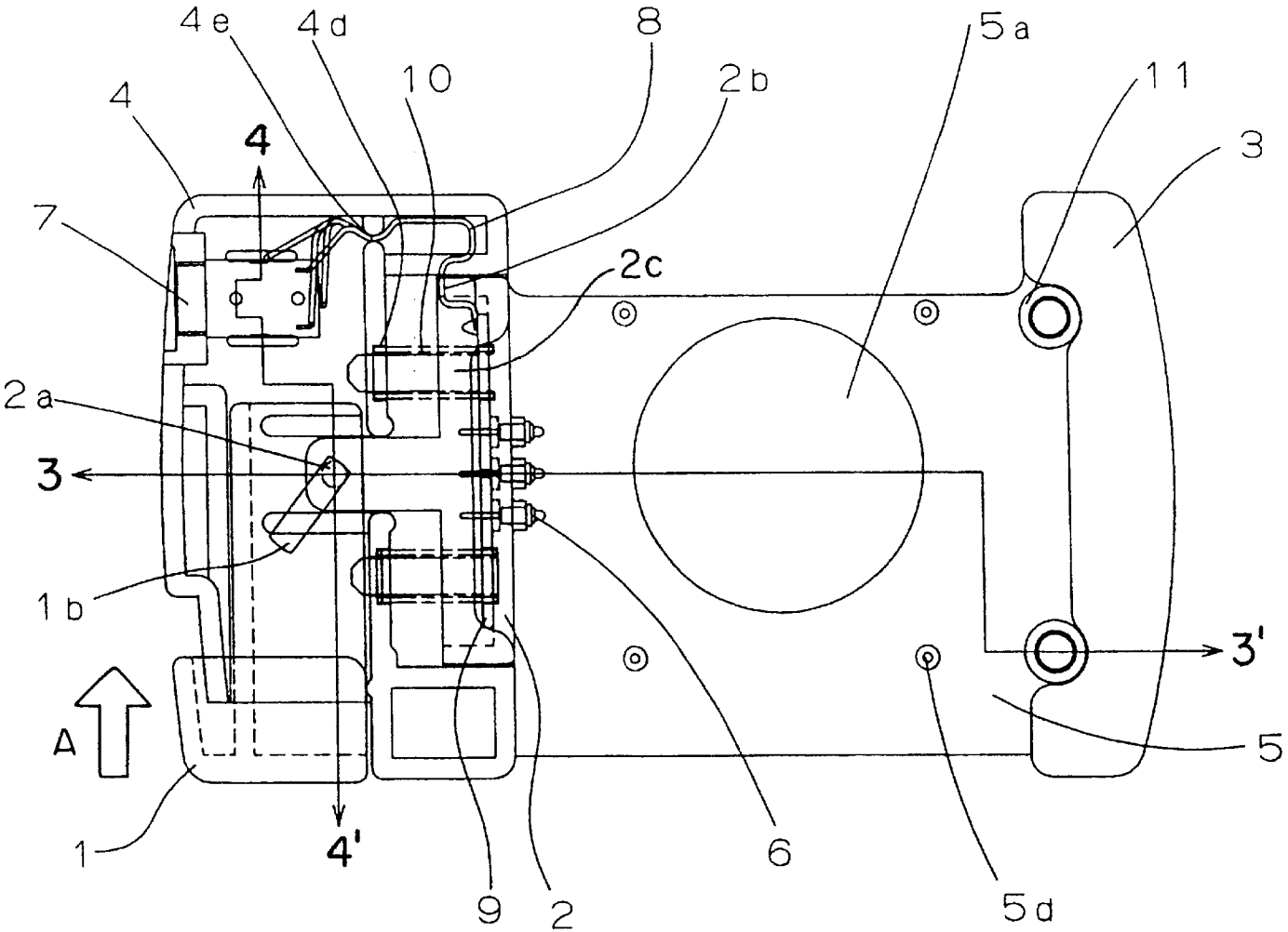
FIG. 2 is a perspective drawing for showing a structure of an interface station according to the embodiment of the present invention.
Figure 3:
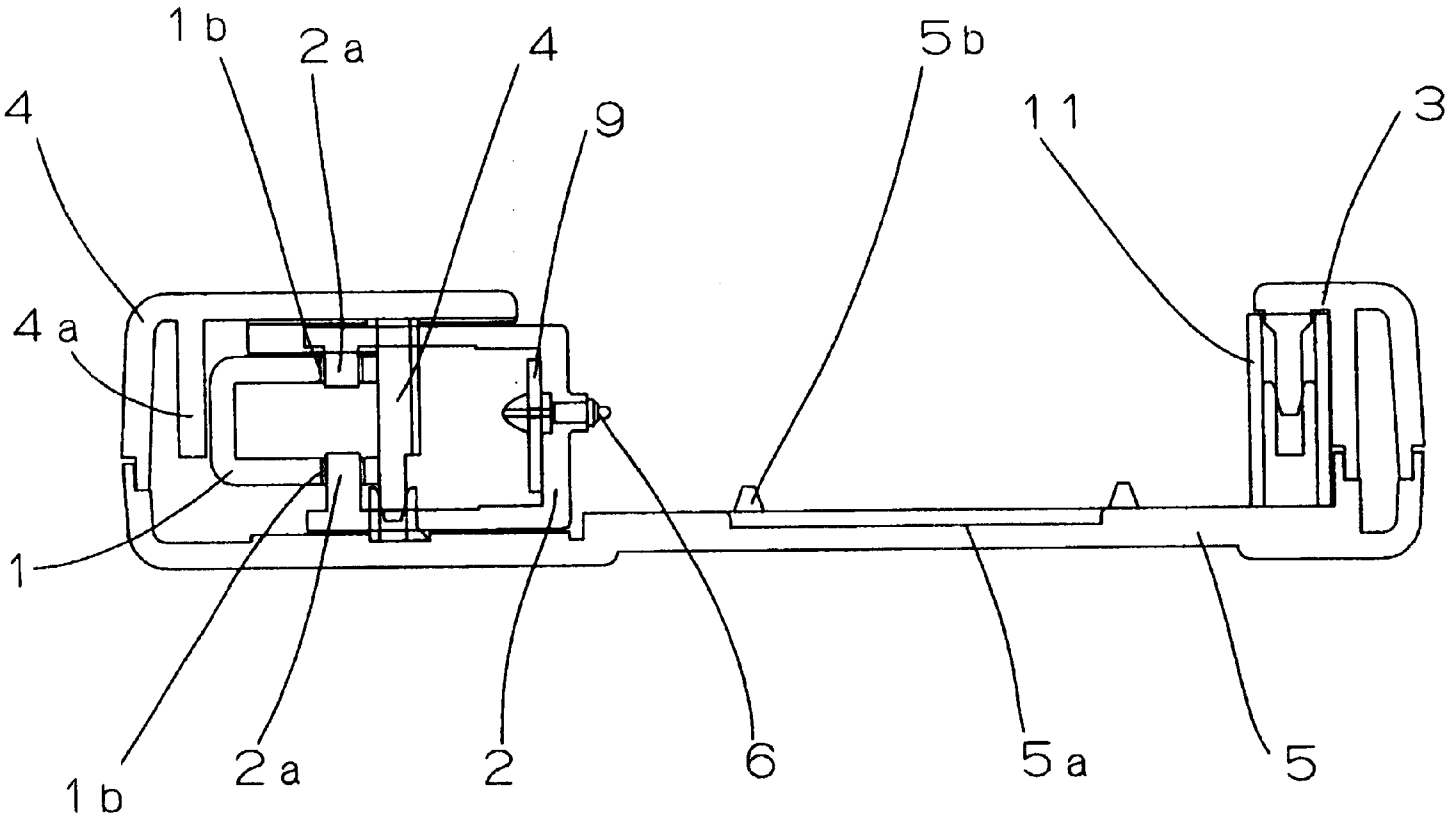
FIG. 3 is a sectional view of the interface station, taken along a line 3–3' of FIG. 2.
Figure 4:
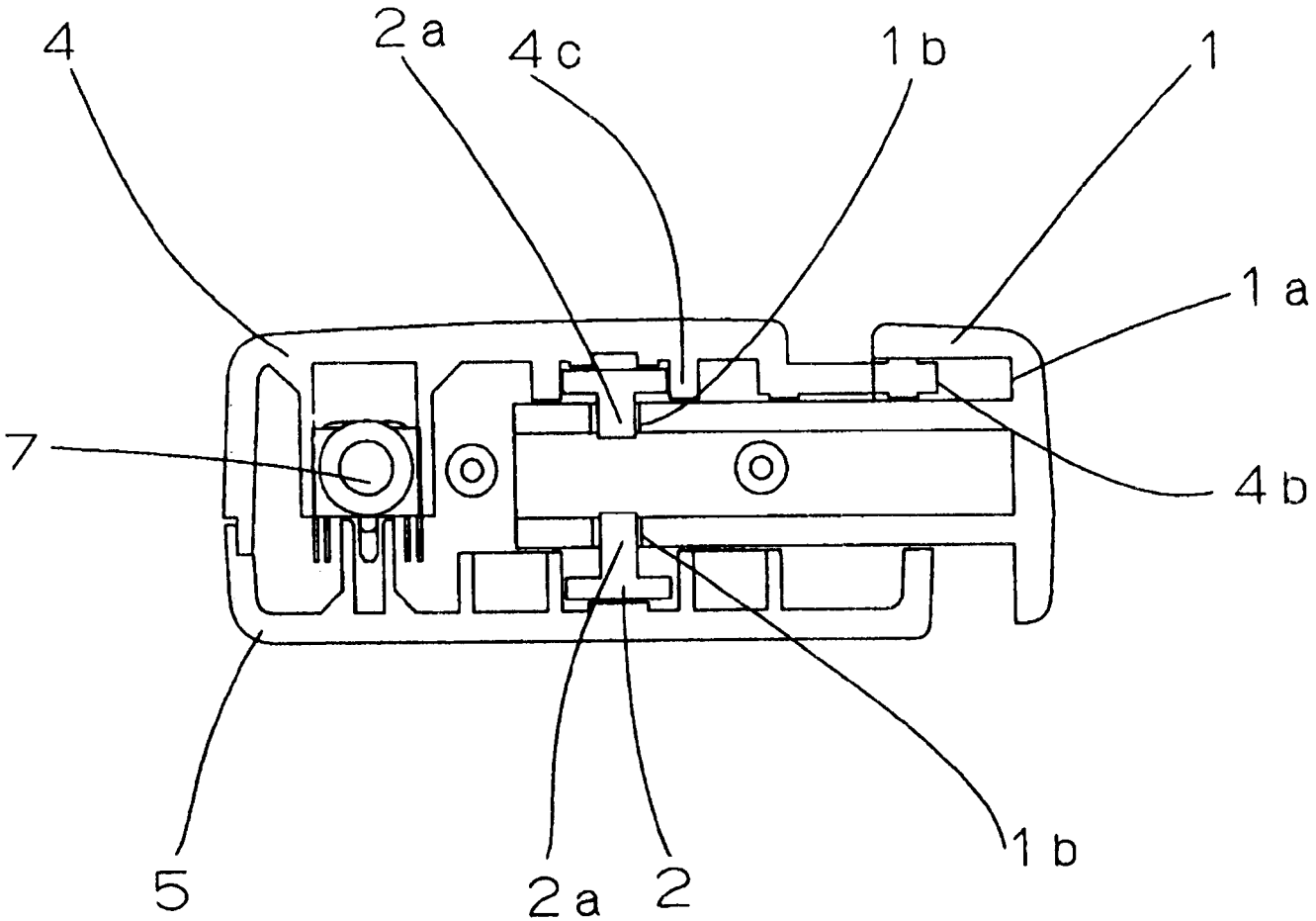
FIG. 4 is a sectional view of the interface station, taken along a line 4–4' of FIG. 2.

FIG. 2 is a perspective drawing of the interface station 22 from which the portable electronic apparatus 21 has been removed. FIG. 3 is a sectional view of the interface station, taken along a line 3–3' of FIG. 2. FIG. 4 is a sectional view of the interface station, taken along a line 4–4' of FIG. 2.

Figure 5:
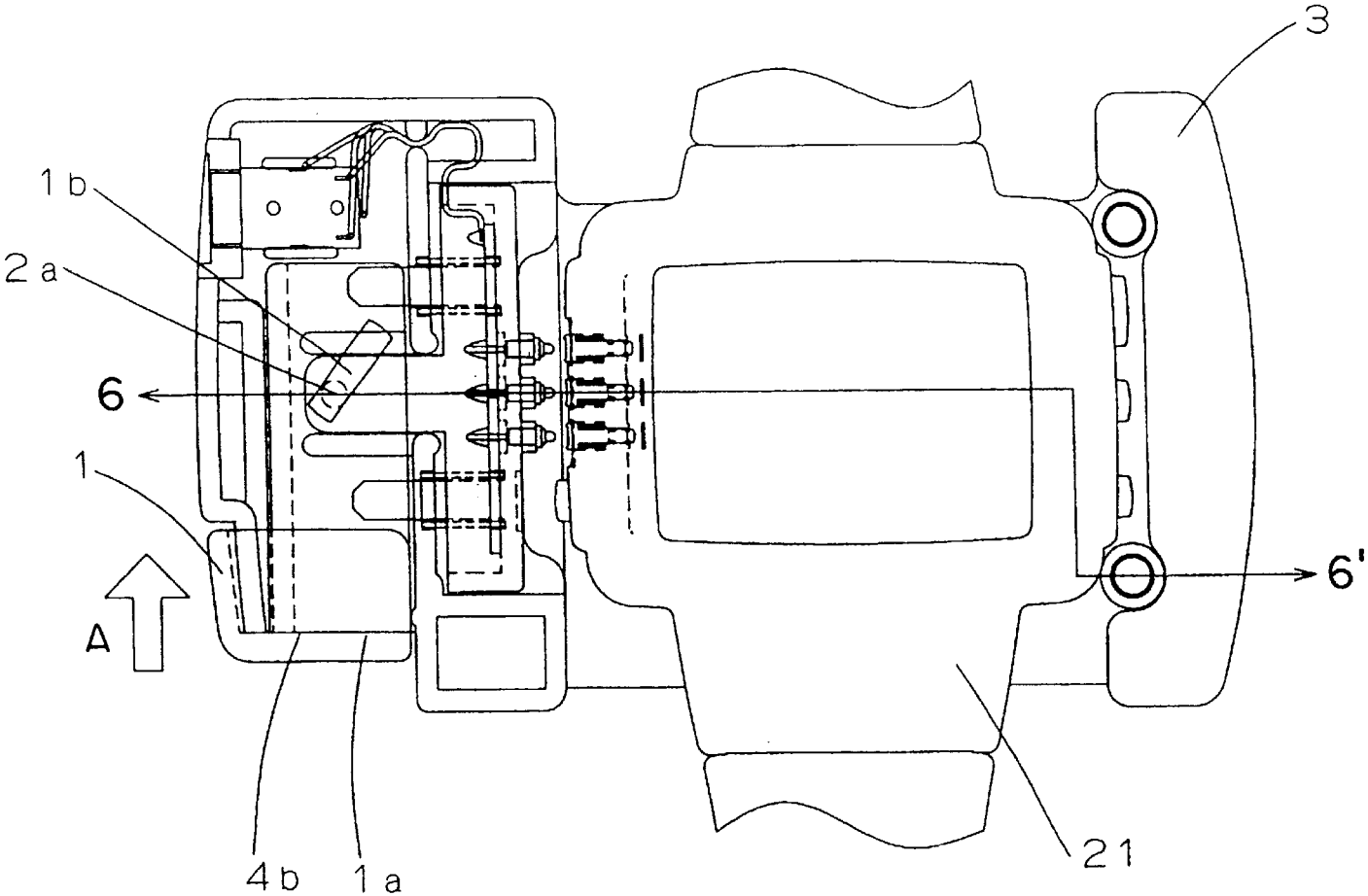
FIG. 5 is a perspective drawing for representing the interface station of the present invention before a portable electronic apparatus is mounted thereon.

FIG. 5 is a perspective drawing of the interface station 22 before the portable electronic apparatus 21 is mounted, where the operation member 1 and the movable member 2 are moved over maximum distances and the interface station 22 is not connected to the portable electronic apparatus. FIG.

6 is a sectional view of the interface station, taken along a line 6–6' of FIG. 5.

Figure 7:
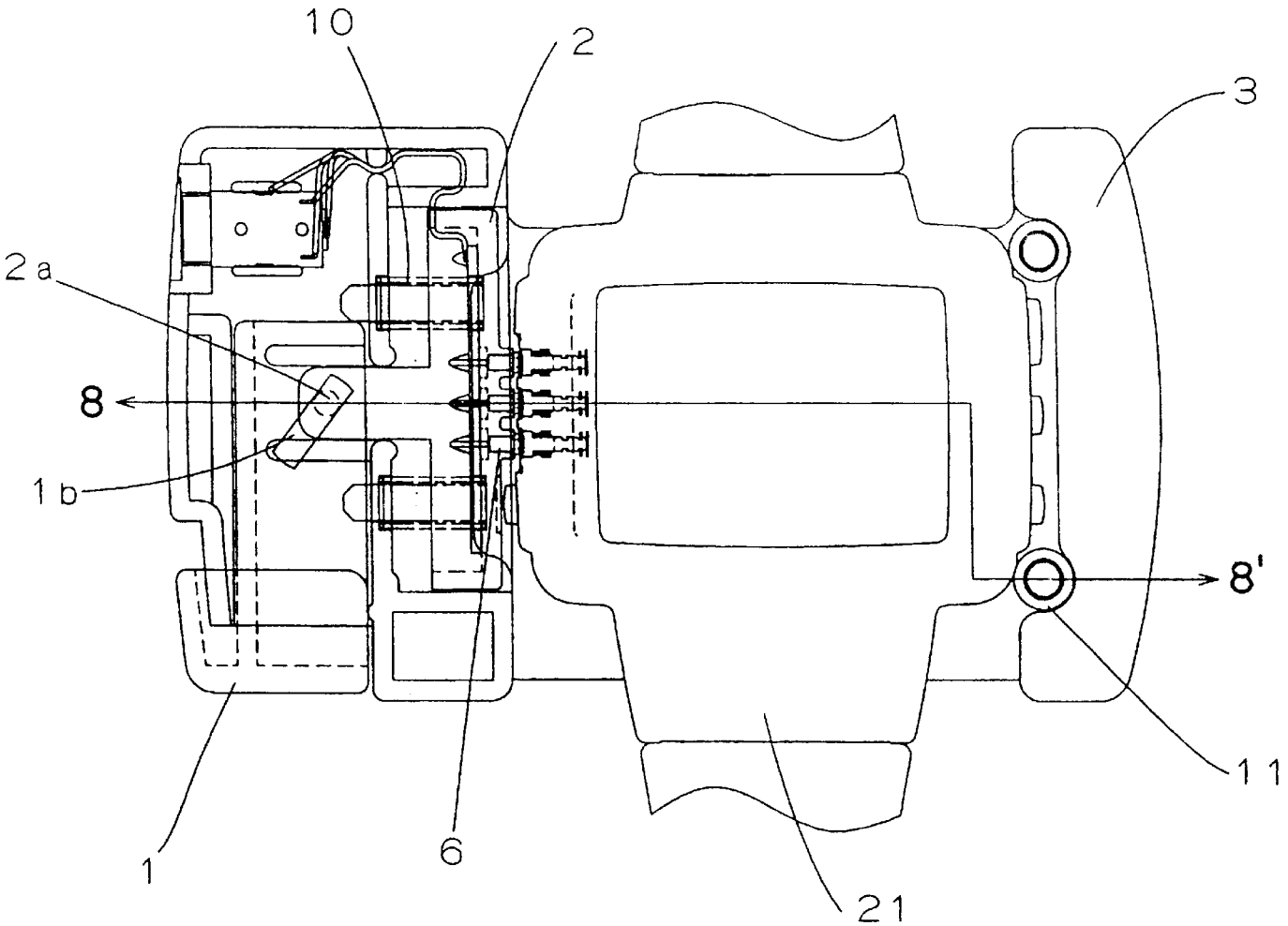
FIG. 7 is a drawing for representing the interface station of the present invention when a portable electronic apparatus is mounted thereon.
Figure 8:
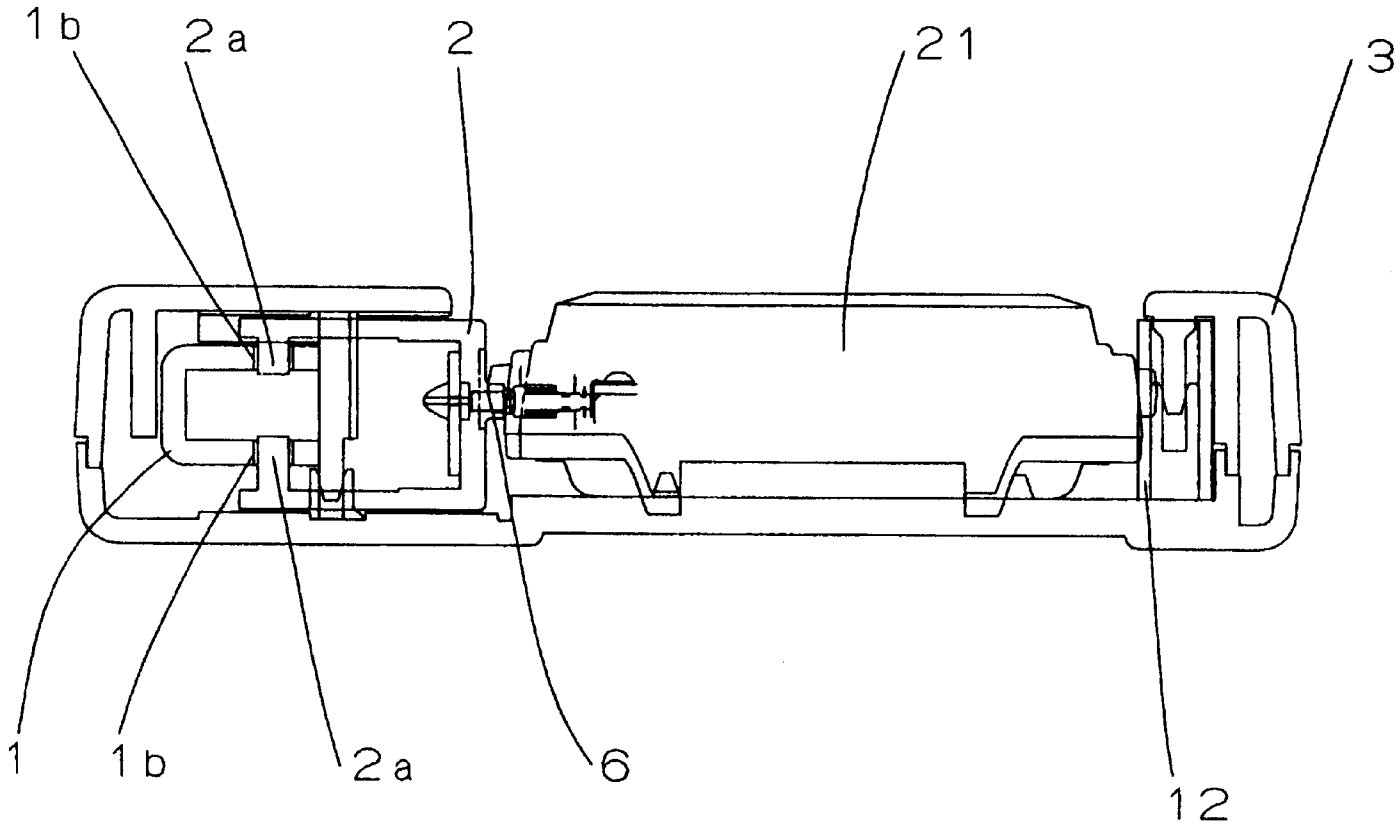
FIG. 8 is a sectional view of the interface station, taken along a line 8–8' FIG. 7.

FIG. 7 is a drawing of the interface station 22 for showing a state in which the portable electronic apparatus 21 is mounted and connected with the interface station 22. FIG. 8 is a sectional view of the interface station 22, taken along a line D1 to D2 of FIG. 7.

An arrangement of this embodiment of the present invention will now be described.

As indicated in FIG. 2, FIG. 3, and FIG. 4, the operation member 1, the movable member 2, and the second connecting terminal 7 are supported by being sandwiched by an upper case 4 and a lower case 5 forming a housing. A fixing rubber 11 having an elastic characteristic is supported by a supporting member 3 and the lower case 5.

The operation direction of the operation member 1 is limited in such a manner that this operation member 1 is actuated along a first convex portion or projection 4*a* formed on the upper case 4. The actuation amount (depression amount) of the operation member 1 is restricted by a stopper portion 4*b* of the upper case 4 coming in contact with an abutting portion l*a* of the operation member, as shown in FIG. 4.

The actuation direction of the movable member 2 is limited in such a manner that the movable member 2 is actuated along a second convex portion 4*c* formed on the upper case 4.

Both the operation member 1 and the movable member 2 serve as an operation direction transforming mechanism. As indicated in FIGS. 2–4, an opening portion 1*b* is formed in the operation member 1, and a convex portion or projection 2*a* inserted into this opening portion 1*b* is formed on the movable member 2. These members may function as the operation direction transforming mechanism. In other words, when the operation member 1 is depressed along the operation direction (along the arrow A in FIG. 2), the operation direction transforming mechanism is actuated, so that the movable member 2 is movable along a direction different from that of the operation member 1.

preferably, the opening portion 1*b* for constituting the operation direction transforming mechanism is made of an elongated hole having an angle selected between 45 degrees and 60 degrees. As indicated in FIG. 2, when the opening portion 1*b* is formed and the operation member 1 is depressed in the direction of arrow A, as viewed in this drawing, the convex portion 2*a* is depressed by the opening portion 1*b* along a left direction, as viewed in the drawing. As a result, the convex portion 2*a* formed on the movable member is also moved along the left direction. Both the distance over which the operation member 1 is moved and the distance over which the movable member 2 is moved may be varied based upon the angle of the opening portion 1*b*.

It should be noted that the members on which the above-described opening portion or projection 1*b* and convex portion or projection 2*a* are provided may be reversed, namely even when the opening portion 1*b* is formed on the movable member 2 and the convex portion 2*a* is formed on the operation member 1, a similar function may be performed.

Also, as the operation direction transforming mechanism, a hole portion may be formed in combination with the operation member 1 and the movable member 2, one of these members is used as the above-described opening portion, and a shaft is inserted into the hole portion and the opening portion so as to engage this hole portion with the opening portion. Then, the movable member 2 may be moved in accordance with the movement of the operation member 1.

A coil spring 10 is supported by a first concave portion 4*d* formed on the upper case 4 and a shaft 2*c* for the coil spring formed on the movable member 2. Since a coil spring is arranged between the first concave portion 4*d* and around the shaft 2*c* for the coil spring, both the operation member 1 and the movable member 2 are returned to an initial position.

The first connecting terminal 6 which is connected to the connecting terminal of the portable electronic apparatus 21 is provided on an edge surface of the movable member 2, and this first connecting terminal 6 is electrically connected to a circuit block 9 employed in the movable member 2.

The second connecting terminal 7 which is connected to the external information processing apparatus 23 is electrically connected via a lead wire 8 to the circuit block 9.

One end of the lead wire 8 is fixed by the concave portion 2*b* of the movable member 2, whereas the other end of this lead wire 8 is fixed by a second concave portion 4*e* of the upper case 4.

Now, a description will be made of detaching operations of the portable electronic apparatus, according to the embodiment of the present invention.

(1). As illustrated in FIG. 2 and FIG. 3, under such a condition that the portable electronic apparatus 21 is removed from the interface station, the positions of the operation member 1 and the movable member 2 are returned to the initial positions thereof by means of the resilience force or bias of the coil spring 10. The mutual position between the opening portion 1*b* formed on the operation member 1 and the convex portion or projection 2*a* provided on the movable member 2 may be defined by engaging the opening portion 1*b* with the convex portion 2*a*, so that the initial positions thereof are maintained. Under this condition, the portable electronic apparatus 21 cannot be mounted.

Figure 6:
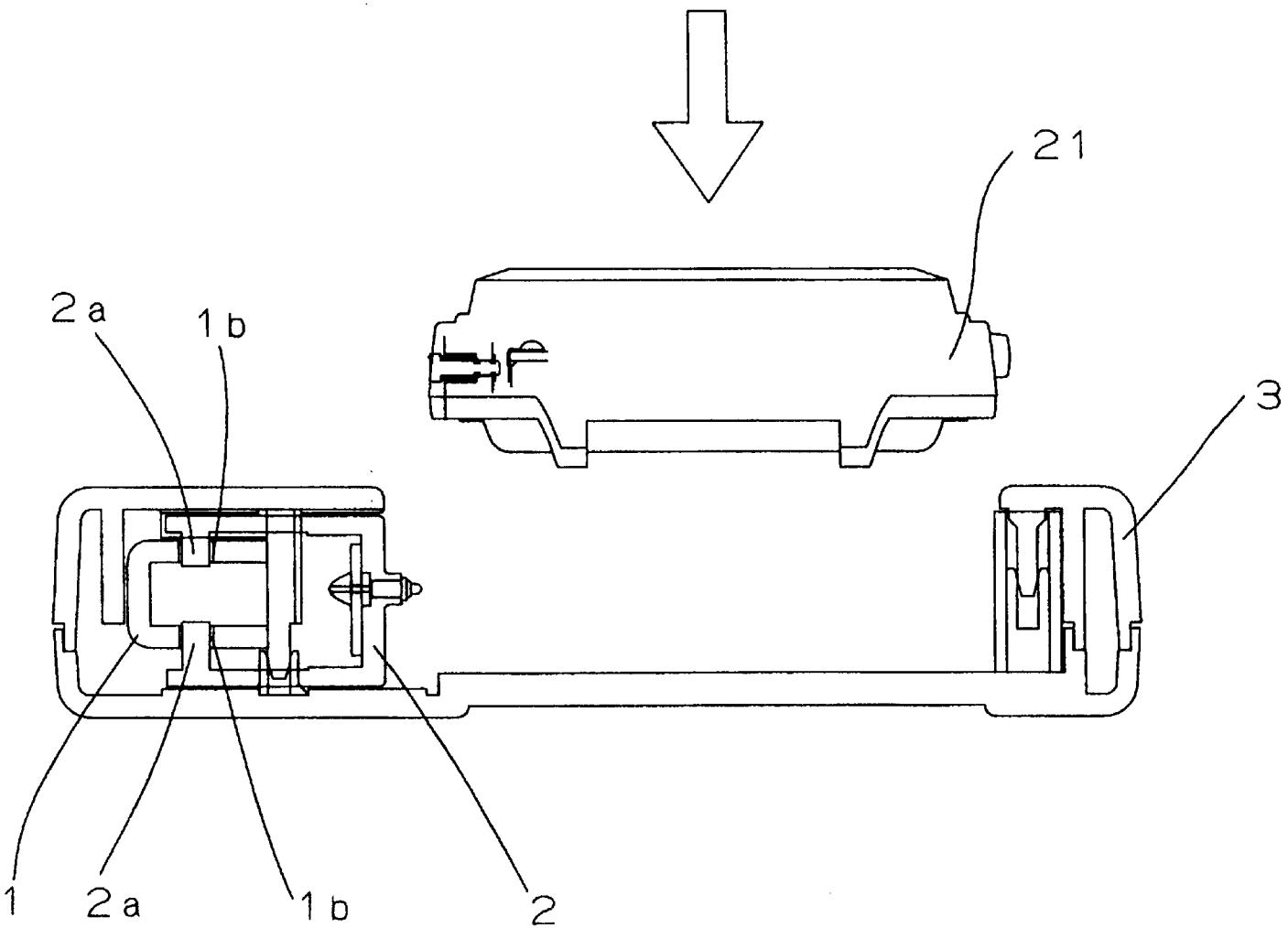
FIG. 6 is a sectional view of the interface station, taken along a line 6–6' of FIG. 5.

(2). As illustrated in FIG. 5 and FIG. 6, under a state of the interface station before the portable electronic apparatus 21 is mounted thereon, when an operator depresses the operation member 1 along the operation direction (namely, in the upper direction of arrow A, as viewed in the drawings) of the operation member 1, the opening portion 1*b* which constitutes a portion of the operation member 1 is moved in the upward direction of arrow A, and further the convex portion 2*a* formed on the movable member 2 is pulled leftward in the drawings on the side of the operation member 1 along the opening portion 1*b* in the direction of the operation member 1 and the vertical direction in combination with the movement of the opening portion 1*b*. At this time, the operation member 1 is moved until the abutting portion 1*a* of the operation member 1 collides with the stopper portion 4*b* of the upper case 4. Also, the movable member 2 is similarly moved in connection with the movement of the operation member 1 until the movement of the operation member 1 is stopped. As a result, the moveable member 2 is moved to the left side, so that sufficient space capable of positioning the portable electronic apparatus 21 at a center of the interface station 22 can be secured.

(3). As represented in FIG. 7 and FIG. 8, when the portable electronic apparatus 21 is mounted on the interface station 22, while maintaining the condition defined in the above-described item (2), the operator positions the portable electronic apparatus 21 at the center of the interface station 22 by targeting the concave portion 5*a* and the convex portion 5*b* (indicated in FIG. 2 and FIG. 3, respectively), which constitute the guide members formed on the lower case 5. Thereafter, when the operator releases the operation member 1, the movable member 2 is returned to the initial position thereof by means of the biasing force of the coil spring 10, and at the same time, the operation member 1 is also returned to the initial position thereof. At the stage when the movable member 2 returned to the initial position, the portable electronic apparatus 21 is depressed along the direction of the supporting member 3, and then is supported by the fixing rubber 11. When the electric connection can be established between the first connecting terminal 6 and the connecting terminal provided on the portable electronic apparatus 21, the movement of the movable member 2 is stopped. At the same time, the movement of the operation member 1 is also stopped.

(4). Similar to the state before the mounting of the portable electronic apparatus 21, when the portable electronic apparatus 21 is removed from the interface station 22, since the operator depresses the operation member 1 along the operation direction, the first connecting terminal 6 is separated from the connecting terminal provided on the portable electronic apparatus 21 in association with the movement of the movable member 2 to thereby release the electric connection established between them. At the same time, the portable electronic apparatus 21 can be removed from the interface station 22. After the portable electronic apparatus 21 is removed under this condition, when the operator releases his hand from the operation member 1, both the operation member 1 and the movable member 2 are returned to the initial positions thereof, and the present condition is returned to the condition as explained in the above item (1).

While the present invention has been described in detail, since it is so arranged that the operation member and the movable member can be mutually moved, the portable electronic apparatus can be readily mounted/removed on/from the interface station without making any scratch by merely manipulating the operation member. At the same time, the interface station can be connected to the portable electronic apparatus. Also, since the fixing rubber having the elastic characteristic is used to be provided on the interface station, such a risk that the portable electronic apparatus is scratched can be reduced. Furthermore, since the portable electronic apparatus can be connected to the interface station without employing the connecting means in this portable electronic apparatus, there is no limitation in designing of the portable electronic apparatus. Also, since the movable member can be moved, the load given to the packaging portion of the lead wire can be reduced by fixing one end of the lead wire to the concave portion of the movable member and also by fixing the other end of the lead wire to the second concave portion of the upper case, so that it is possible to prevent the lead wire connected between the circuit block and the second connecting terminal from being disconnected. Also, since the operation member is arranged on the left side in the interface station, this interface station can be manipulated only by using the left hand of the operator, and also the portable electronic apparatus can be mounted on this interface station by using the right hand of the operator. At this time, since the operator can observe the electric connection established between the first connecting terminal provided on the left side of the portable electronic apparatus, and the connecting terminal of the portable electronic apparatus held by the right hand, the operator can readily confirm such an electric connection between them.

What is claimed is:

1. An interface station for supporting and interfacing a portable electronic apparatus to an external information processing apparatus, comprising:

a displaceable operation member disposed to undergo guided displacement in response to external manipulation;

a movable member mounted to undergo movement in a given direction in conjunction with movement of the operation member so that the movable member is normally in an extended position in the given direction and is retracted from the extended position in response to manual displacement of the operation member;

a supporting member for supporting the portable electronic apparatus, the displaceable operation member and the movable member and maintaining the portable electronic apparatus in a given position with respect to the movable member; and a first connecting terminal provided on the movable member for electrically and mechanically connecting to a contact within the portable electronic apparatus when the portable electronic apparatus is mounted on the supporting member and the moveable member is disposed in the extended position in the given direction so that the portable electronic apparatus is mechanically supported by the interface station, and for disconnecting electrically and mechanically from the contact within the portable electronic apparatus in response to manual displacement of the operation member;

wherein the portable electronic apparatus is held by both the supporting member and the movable member via the mechanical connection between the first connecting terminal and the contact, so that the portable electronic apparatus may be electrically connected via the interface station to the external information processing apparatus.

2. An interface station as claimed in claim 1; wherein both the operation member and the movable member are arranged at one of a right side and a left side of the position at which the portable electronic apparatus is arranged for connection to the connecting terminal, and the supporting member has a side portion arranged at the other of the right side and the left side of the portable electronic apparatus so that the portable electronic apparatus is supported by the first connecting terminal at one side and the side portion of the supporting member at the other side during connection to the external information processing apparatus.

3. An interface station as claimed in claim 1; wherein the operation member and the movable member are arranged in such manner that the direction of movement of the movable member is different from that of the operation member; and further comprising operation direction transforming means for connecting the operation member and the movable member so that the movable member undergoes movement in the given direction in response to manual displacement of the operation member and transforming the movement of the operation member so that movement of the operation member in one direction causes movement of the movable member in a different direction.

4. An interface station as claimed in claim 1; further comprising operation direction transforming means comprising an elongated opening portion formed in one of the operation member and the movable member, and a convex portion slidably engaged in the elongated opening portion formed on the other one of the operation member and the movable member; wherein the movable member is moved in conjunction with the movement of the operation member by connecting to the operation member by engagement of the convex portion and the elongated opening portion.

5. An interface station as claimed in claim 3; wherein the operation direction transforming means comprises an elongated slot formed in one of the operation member and the movable member, the slot being disposed at an angle between 45 degrees and 60 degrees with respect to the direction of movement of the operation member; and a convex portion formed on the other one of the operation member and the movable member, the convex portion being slidably engaged in the elongated slot;

wherein the movable member is moved in conjunction with the movement of the operation member by engagement of the convex portion with the elongated hole.

6. An interface station as claimed in claim 1; further comprising a second connecting terminal for connecting to the external information processing apparatus, and a lead wire for connecting the first connecting terminal with the second connecting terminal; wherein a portion of the lead wire proximate a first end of the lead wire which is connected to the first connecting terminal is fixed by a first concave portion formed in the movable member and a portion of the lead wire proximate a second end of the lead wire which is connected to the second connecting terminal is fixed by a second concave portion formed in a upper case.

7. An interface station as claimed in claim 1; wherein the portable electronic apparatus comprises a wrist watch type information processing apparatus.

8. An information processing apparatus comprising:

the interface station according to any one of claim 1 to claim 7;

an external information processing apparatus connected to the interface station; and a portable electronic apparatus connected to the external information processing apparatus and supported by the interface station.

9. An interface station for supporting and interfacing a portable electronic apparatus to an external information processing apparatus, comprising: a housing;

a supporting member contained in the housing for supporting a portable electronic device which is connectable to an external information processing apparatus; a movable member mounted in the housing to undergo guided movement in response to an externally applied force; means for biasing the movable member in an extended position; and a first connecting terminal mounted to the movable member for connecting to a contact located on the portable electronic device; wherein when the portable electronic device is positioned in the supporting member the movable member is in the extended position so that the connecting terminal of the movable member becomes engaged with the contact of the portable electronic device and the portable electronic device is supported in position by the supporting member and the connecting terminal, and the movable member is retracted from the extended position in response to an externally applied force.

10. An interface station according to claim 9; further comprising a manually displaceable member mounted in the housing and having a first portion extending inside the housing and a second portion extending outside the housing, to undergo guided displacement in response to an externally applied force, and being connected to the moveable member within the housing so that the movable member undergoes guided movement in conjunction with the manually displaceable member in response to an externally applied force so that the movable member is normally biased in the extended position and is retracted from the extended position in response to the externally applied force.

11. An interface station according to claim 10; wherein one of the manually displaceable member and the movable member has a slot and the other one has a tab, the tab being slidably engaged within the slot so that the manually displaceable member and the movable member are slidably connected and movement of the manually displaceable member causes movement of the movable member.

12. An interface station according to claim 11; wherein the slot extends at an acute angle with respect to the direction of guided movement of the manually displaceable member so that the direction of movement of the movable member is different from the direction of movement of the manually displaceable member.

13. An interface station according to claim 9; further comprising a second connecting terminal for connecting the portable electronic device to an external information processing device.

14. An interface station as claimed in claim 1; further comprising means for biasing the movable member in the extended position so that the movable member is in the extended position in a normal state and manual displacement of the operation member causes the movable member to retract from the extended position against a biasing force applied by the biasing means.

15. An interface station as claimed in claim 14; wherein the means for biasing the movable member comprises at least one spring.

16. An interface station according to claim 9; wherein the means for biasing the movable member comprises at least one spring.

17. An interface station according to claim 9; wherein the portable electronic apparatus comprises an information processing apparatus.

18. An interface station according to claim 17; wherein the portable electronic apparatus comprises a wearable information processing apparatus.

19. An interface station according to claim 9; wherein the portable electronic apparatus comprises a wristwatch type information processing apparatus.

* * * * *